US007470497B2

(12) United States Patent
Yuasa et al.

(10) Patent No.: US 7,470,497 B2
(45) Date of Patent: Dec. 30, 2008

(54) TWO-COMPONENT DEVELOPER HAVING A RESIN COATED CARRIER FOR ELECTROPHOTOGRAPHY AND TONER

(75) Inventors: Yasuhito Yuasa, Katano (JP); Kiminori Umeda, Amagasaki (JP); Tetsuya Uemura, Kashiwa (JP); Tsuyoshi Itagoshi, Matsudo (JP)

(73) Assignee: Panasonic Corporation, Osaka (JP)

( * ) Notice: Subject to any disclaimer, the term of this patent is extended or adjusted under 35 U.S.C. 154(b) by 422 days.

(21) Appl. No.: 10/529,536

(22) PCT Filed: Sep. 30, 2003

(86) PCT No.: PCT/JP03/12463

§ 371 (c)(1),
(2), (4) Date: Mar. 29, 2005

(87) PCT Pub. No.: WO2004/031865

PCT Pub. Date: Apr. 15, 2004

(65) Prior Publication Data

US 2006/0051695 A1 Mar. 9, 2006

(30) Foreign Application Priority Data

Oct. 2, 2002 (JP) ..... 2002-290308

(51) Int. Cl.
*G03G 9/087* (2006.01)
*G03G 9/113* (2006.01)

(52) U.S. Cl. ..... 430/109.4; 430/111.32; 430/111.33; 430/111.35

(58) Field of Classification Search ..... 430/111.35, 430/111.32, 111.33, 109.4
See application file for complete search history.

(56) References Cited

U.S. PATENT DOCUMENTS

| | | | | |
|---|---|---|---|---|
| 5,288,578 | A | 2/1994 | Sugizaki et al. | |
| 5,314,777 | A | 5/1994 | Watanabe et al. | |
| 5,393,631 | A | 2/1995 | Horikoshi et al. | |
| 5,567,561 | A | 10/1996 | Yoshikawa et al. | |
| 6,472,118 | B1 * | 10/2002 | Yamaguchi et al. | 430/111.35 |
| 6,544,707 | B2 | 4/2003 | Nakamura et al. | |
| 6,686,113 | B2 | 2/2004 | Kobayashi et al. | |
| 6,790,575 | B2 * | 9/2004 | Sasaki et al. | 430/111.35 |
| 7,070,897 | B2 * | 7/2006 | Imafuku et al. | 430/111.35 |
| 2003/0091923 | A1 * | 5/2003 | Kobayashi et al. | 430/111.33 |
| 2003/0224279 | A1 * | 12/2003 | Kotsugai et al. | 430/111.35 |
| 2004/0229151 | A1 * | 11/2004 | Kobayashi et al. | 430/111.33 |
| 2006/0051695 | A1 * | 3/2006 | Yuasa et al. | 430/111.35 |

FOREIGN PATENT DOCUMENTS

| | | | |
|---|---|---|---|
| JP | 60-19156 | A | 1/1985 |
| JP | 60-213961 | A | 10/1985 |
| JP | 61-80161 | A | 4/1986 |
| JP | 61-80162 | A | 4/1986 |
| JP | 61-80163 | A | 4/1986 |
| JP | 62-121463 | A | 6/1987 |
| JP | 2-24670 | A | 1/1990 |
| JP | 4-306666 | | 10/1992 |
| JP | 5-72815 | | 3/1993 |
| JP | 5-134467 | A | 5/1993 |
| JP | 5-188654 | | 7/1993 |
| JP | 5-204189 | A | 8/1993 |
| JP | 6-11908 | A | 1/1994 |
| JP | 6-337547 | A | 12/1994 |
| JP | 7-77839 | A | 3/1995 |
| JP | 7-104522 | A | 4/1995 |
| JP | 7-209902 | | 8/1995 |
| JP | 7-209903 | | 8/1995 |
| JP | 7-230181 | | 8/1995 |
| JP | 7-325426 | A | 12/1995 |
| JP | 2619439 | B2 | 3/1997 |
| JP | 2744790 | B2 | 2/1998 |
| JP | 2801507 | B2 | 7/1998 |
| JP | 2002-23429 | A | 1/2002 |
| JP | 2002-268267 | A | 9/2002 |
| JP | 2002-278167 | A | 9/2002 |

OTHER PUBLICATIONS

Dow Corning Toray SR 2411 Resin (Jul. 17, 2007).*
Diamond, Arthur S & David Weiss (eds.) Handbook of Imaging Materials, 2nd ed.. New York: Marcel-Dekker, Inc. (Nov. 2001) pp. 220 & 221.*
Chemical Abstracts Registry entry for "KBE 903" (Reg. # 919-30-2).*
Chemical Abstracts Registry entry for "KBE 903" (Reg # 919-30-2). date: 2007.*

* cited by examiner

*Primary Examiner*—Christopher RoDee
(74) *Attorney, Agent, or Firm*—Hamre, Schumann, Mueller & Larson, P.C.

(57) ABSTRACT

The present invention is a carrier for electrophotography in which a surface of at least a core material is coated with a resin, in which the coating resin contains a fluorine modified silicone resin and an aminosilane coupling agent, and in which the carrier charges a toner negatively. Consequently, a carrier with a high durability and a long lifetime for electrophotography is provided, in which the charge amount does not decrease at high temperature or high humidity nor extremely increase at low temperature or low humidity, in which a deterioration of a developing agent caused by stripping of a coating layer is prevented, and in which a deterioration caused by formation of spent toner of a toner is not caused.

9 Claims, 1 Drawing Sheet

TWO-COMPONENT DEVELOPER HAVING A RESIN COATED CARRIER FOR ELECTROPHOTOGRAPHY AND TONER

TECHNICAL FIELD

The present invention relates to a carrier for electrophotography that is used for a copier, a laser printer, a plain paper fax, a color PPC, a color laser printer, a color fax, or a multifunctional machine of these.

BACKGROUND ART

Conventional electrophotographic processes generally use a method in which an electrostatic latent image is formed on a photosensitive member or an electrostatic recording member by using various means, a toner is adhered to this electrostatic latent image, and then the electrostatic latent image is developed.

In this development, carrier particles called "carriers" are mixed with toner particles so as to charge each other triboelectrically, and thus positive or negative electric charge of an appropriate amount is imparted to the toner. Carriers are classified roughly into coated carriers that have a coating layer on their surface and uncoated carriers that do not have a coating layer on their surface. Coated carriers are superior to uncoated carriers in light of, for example, the lifetime of the developing agent.

Among the various properties required for a coated carrier that are particularly important are a property of imparting an appropriate charge (the amount and the distribution of electric charge) to a toner, a property of keeping the appropriate charge on the toner for a long period of time, and for this purpose, shock resistance, abrasion resistance, a property of sufficiently inhibiting formation of spent toner, and a property of preventing a change in the charge on the toner by resisting environmental changes such as humidity or temperature. Various coated carriers have been proposed.

For the purpose of providing a long-lived coated carrier, JP S61-80163A, for example, proposes a technique in which a surface of a carrier core material is coated with a resin such as a copolymer of a vinyl monomer and fluorinated alkyl (meth) acrylate containing nitrogen, or a copolymer of fluorinated alkyl (meth)acrylate and a vinyl monomer containing nitrogen. JP H2-24670A, for example, proposes use of a copolymer of a vinyl monomer and fluorinated alkyl (meth)acrylate containing nitrogen, and a copolymer of fluorinated alkyl (meth)acrylate and a vinyl monomer. Furthermore, JP H6-11908A, for example, proposes a solvent-soluble fluorine-containing polymer having an imide bond. According to these, a coated carrier with a relatively long lifetime is obtained by coating a surface of the carrier core material with a copolymer of a nitrogen-containing monomer and a fluorinated monomer, or a solvent-soluble fluorine-containing polymer having an imide bond. However, the coated carrier may not withstand use for a long period of time when these copolymer resins are used. This is because the adhesive strength of the coating resins at an adhesive interface with the carrier is poor due to an influence of a low surface energy of the fluorine group, and because sufficient shock resistance cannot be obtained due to the insufficient strength of the resins as a coating agent. Furthermore, in order to charge the toner negatively, the amount of added fluorinated monomer needs to be kept small, and thus it was not possible to obtain a charged member having a sufficiently low surface energy while imparting a sufficient charge to the toner. Consequently, over a long period of use, formation of spent toner of the toner or an external additive to the charged member cannot be inhibited sufficiently. Thus the charge characteristics deteriorate with the time of usage, so that problems such as image fog or density non-uniformities are caused. "Formation of spent toner" refers to the phenomenon that, for example, a toner, an external additive and/or a colorant are/is firmly adhered or fused on a surface of a charged member due to heat generated by mechanical collision or friction, for example, between particles or between a particle and a developing device.

Furthermore, JP H7-325426A, for example, proposes a long-lived coated carrier in which a fluororesin is mixed and used together with a resin conventionally used as a coating material of a carrier for electrophotography (for example, an acrylic resin, an epoxy resin, styrene, a styrene-acrylic resin, or a silicone resin) as a binder or a primer, so that the poor adhesive strength of the fluororesin as described above is reinforced.

However, when the fluororesin, which is more negative in the triboelectric series, and the binder resin, which is more positive in the triboelectric series, are mixed to coat the surface of the carrier core material as described above, there is a difference in the characteristics such as the melting point of these resins. Thus a uniform resin coating layer is difficult to obtain, there is a broad distribution of charge amounts, and image defects such as fog or toner scattering are caused, and the transfer efficiency may be lowered.

Furthermore, fluororesins have the characteristic of moving to the outermost layer of the resin coating layers when mixed and used with another resin, and thus the charge amount decreases significantly for a negatively charged toner. In addition, when the coating layer is stripped by a long period of use, the fluororesin is stripped first, and the binder resin appears at the outer layer with the time of usage, and thus a change in, for example, charge characteristics becomes significant.

A carrier coated with a silicone resin coating layer has been proposed conventionally as a carrier having a relatively low surface energy. Although formation of spent toner of a toner tends to occur less if the coating layer is made of a silicone resin due to its relatively low surface energy, the effect is not sufficient. Furthermore, due to its low surface energy and high insulation, the charge amount is extremely difficult to increase, and image defects such as fog or toner scattering tend to occur.

Use of a silane coupling agent has been proposed in order to improve the adhesiveness of a resin coating layer to address image deterioration (for example, insufficient image density or image fog defects) caused when the resin coating layer on a surface of a carrier is stripped or lost due to, for example, collision between carriers or friction between a development box and a carrier due to stirring (JP S60-19156A). Although the adhesiveness of the coating layer is improved, there is a problem that toner scattering or image fog is caused due to fluctuation in the charge amount under various environmental conditions.

For the purpose of improving the adhesiveness between a carrier core material and a silicone resin, JP S62-121463A, for example, illustrates a carrier in which a coating layer made of a silicone resin is provided on a surface of a carrier core material treated with a silane coupling agent. However, the outermost surface of this carrier is not provided with a component of an aminosilane coupling agent containing an effective amino group, and thus the carrier cannot impart charge to a negatively charged toner sufficiently, and scattering is caused at the time of printing. Thus, a satisfactory carrier still is not obtained.

Furthermore, Japanese Patent No. 2744790, for example, proposes a carrier that is coated with a silicone resin containing an aminosilane coupling agent, for the purpose of preventing a decrease in the charge amount on a toner in a highly humid atmosphere and of improving durability of a developing agent, when used in combination with a toner with its components limited. A decrease of the charge amount throughout its lifetime can be improved by the limitation of the toner components and the effect of the aminosilane coupling agent. However, the formation of spent toner of the toner is not inhibited sufficiently, although it tends to occur less.

Recently, JP H5-134467A, for example, has proposed a resin layer containing an aminosilane coupling agent that is double-coated and in which the components or additives in the resin of the intermediate and the outermost layer are different.

Furthermore, JP H5-204189A illustrates a carrier characterized in that a density gradient of, for example, a silane coupling agent is provided in a thickness direction of a silicone resin layer. The carrier does not have uniform constituents in the carrier resin layers, and thus the silicone resin-coated carrier particularly changes over time when left standing, and a difference in hardening appears between the outermost layer and the intermediate layer of the resin layers. Therefore, a significant difference in charge characteristics appears between toners from the initial stage of production and toners after a certain period of time, the charge amount decreases at high humidity when a conductive material is added, and carrier resistance changes significantly if the resin layers are stripped or lost at the time of printing. Thus, in the final evaluation, it cannot be said to have durability.

Furthermore, JP H7-104522A proposes a resin-coated carrier for a developing agent of electrophotography characterized in that a carrier core material has a resin coating layer made of a silicone resin or a modified silicone resin containing an aminosilane coupling agent, in that the aminosilane coupling agent is present in the coating resin in a range of 6 to 25 weight percents, and in that the equivalent weight of amino groups in the aminosilane coupling agent ranges from 163 to 235. In this technique, a base resin of the resin coating layer containing the aminosilane coupling agent is a silicone resin or a modified silicone resin. Examples of the modified silicone resin include various modified silicone resins such as an alkyd resin, a polyester resin, an epoxy resin, a polyurethane resin, and an acrylic resin. These base resins cannot inhibit sufficiently formation of spent toner of a toner or an external additive to charged members over a long period of use, and thus their charge characteristics deteriorate with the time of usage, so that problems such as image fog or density nonuniformities are caused.

For the purpose of obtaining a negatively charged carrier (a positively charged developing agent) whose triboelectrical charge characteristics are excellent and in which stripping tends not to occur, JP S60-213961A proposes a carrier in which a coating layer containing a terminal perfluoro alkylsilane coupling agent in a silicon varnish is formed on a core surface. However, the silicon varnish and the terminal perfluoro alkylsilane coupling agent are difficult to apply uniformly, and thus the coating layer tends to be nonuniform, such as generated when a fluororesin and a binder resin are mixed and used together as described above. Consequently, there is a broad distribution of charge amounts, and image defects such as fog or toner scattering are caused.

Japanese Patent No. 2801507 proposes a carrier in which for a positively charged toner, a fluorine-substituted alkyl group is introduced to a silicone resin of a coating layer. Furthermore, as a carrier in which development properties in a high speed process are high and whose properties are not deteriorated over a long period of time, JP 2002-23429A proposes a coated carrier containing conductive carbon and a crosslinked fluorine modified silicone resin. This carrier takes advantage of excellent charge characteristics of the silicone resin, imparts characteristics such as sliding properties, stripping properties due to the fluorine-substituted alkyl group, and water-repelling properties, tends not to cause abrasion, stripping, or cracks, and can prevent formation of spent toner. However, abrasion, stripping, or cracks are not prevented satisfactorily. Furthermore, although an appropriate charge amount can be obtained for a positively charged toner, the charge amount is too small when a negatively charged toner is used, so that a large amount of oppositely charged toner (positively charged toner) is generated. Consequently, fog or toner scattering is aggravated, and thus the carrier may not withstand use. Furthermore, the transfer efficiency may be lowered.

In other words, a carrier having a resin coating layer containing only fluororesin can be used only for a positively charged toner due to the position in the triboelectric series, and the adhesive strength of the coating resin at an adhesive interface with the carrier is poor. Furthermore, the carrier cannot obtain sufficient shock-resistance due to the insufficient strength of the resin as a coating agent, and thus it may not withstand use for a long period of time.

When a fluororesin and another resin are mixed and used, a uniform resin coating layer is difficult to obtain, there is a broad distribution of charge amounts, and image defects such as fog or toner scattering are caused. Furthermore, fluororesins have the characteristic of moving to the outermost layer of the resin coating layers when mixed and used with another resin, and thus the charge amount decreases extremely for a negatively charged toner. In addition, when the coating layer is stripped by a long period of use, the fluororesin is stripped first, and the binder resin appears at the outer layer with the time of usage. Thus a change in, for example, charge characteristics becomes significant.

In recent years, it has been increasingly required to reproduce uniformly an image including a large amount of solid portion such as barcodes or an image such as graphic designs, instead of, for example, documents including a large amount of printed letter printed by, for example, printers. For example, particularly in full color development, solid portions are larger than text portions, and thus the amount of consumed or supplied toner increases, and it is desirable that the toner maintains the desired charge characteristics all the time under various environmental conditions. In these recent electrophotographic processes with large toner consumption and high replenishment development conditions, the above-described carrier having a silicone resin and a silane coupling agent such as an aminosilane coupling agent can impart some charge to a negatively charged toner, and has some durability over a long period of use. However, the carrier cannot impart charge sufficiently to a small sized toner or a high density toner for high definition for use in recent printers or full color developing devices dealing with a large amount of solid portion, and cannot increase the charge amount instantly with respect to toner supplied at the time of printing. Ultimately, a sufficient durability cannot be attained at present.

In a carrier having a resin coated-layer in which a terminal perfluoro alkylsilane coupling agent or a fluorine-substituted alkyl group is introduced to a silicone resin, although some improvement of the formation of spent toner can be confirmed, an appropriate charge amount cannot be obtained when used for a negatively charged toner. Furthermore, the coating film is not sufficiently uniform, and the carrier cannot satisfactorily prevent abrasion or stripping of the resin coating layer caused by downsizing of devices to cope with the recent space-saving trend and by increased stress on the carrier in a developing device in accordance with realization of high speed performance.

DISCLOSURE OF INVENTION

An object of the present invention is to provide a carrier for electrophotography in which the above-described conventional problems are solved, in which the charge amount does not decrease at high temperature or high humidity nor extremely increase at low temperature or low humidity, in which the charge amount can increase instantly with respect to toner supplied at the time of printing, in which the toner consumption amount is excellent due to high transfer efficiency, in which a long lifetime of the carrier is realized based on a high durability that prevents deterioration of a developing agent caused by stripping of a coating layer and that also prevents a deterioration caused by the formation of spent toner of the toner, and in which the carrier charges a toner negatively.

In order to achieve the above-described objects, in a carrier for electrophotography according to the present invention, a surface of at least a core material is coated with a resin, the coating resin contains a fluorine modified silicone resin and an aminosilane coupling agent, and the carrier charges a toner negatively.

BEST MODE FOR CARRYING OUT THE PRESENT INVENTION

Figure 1:
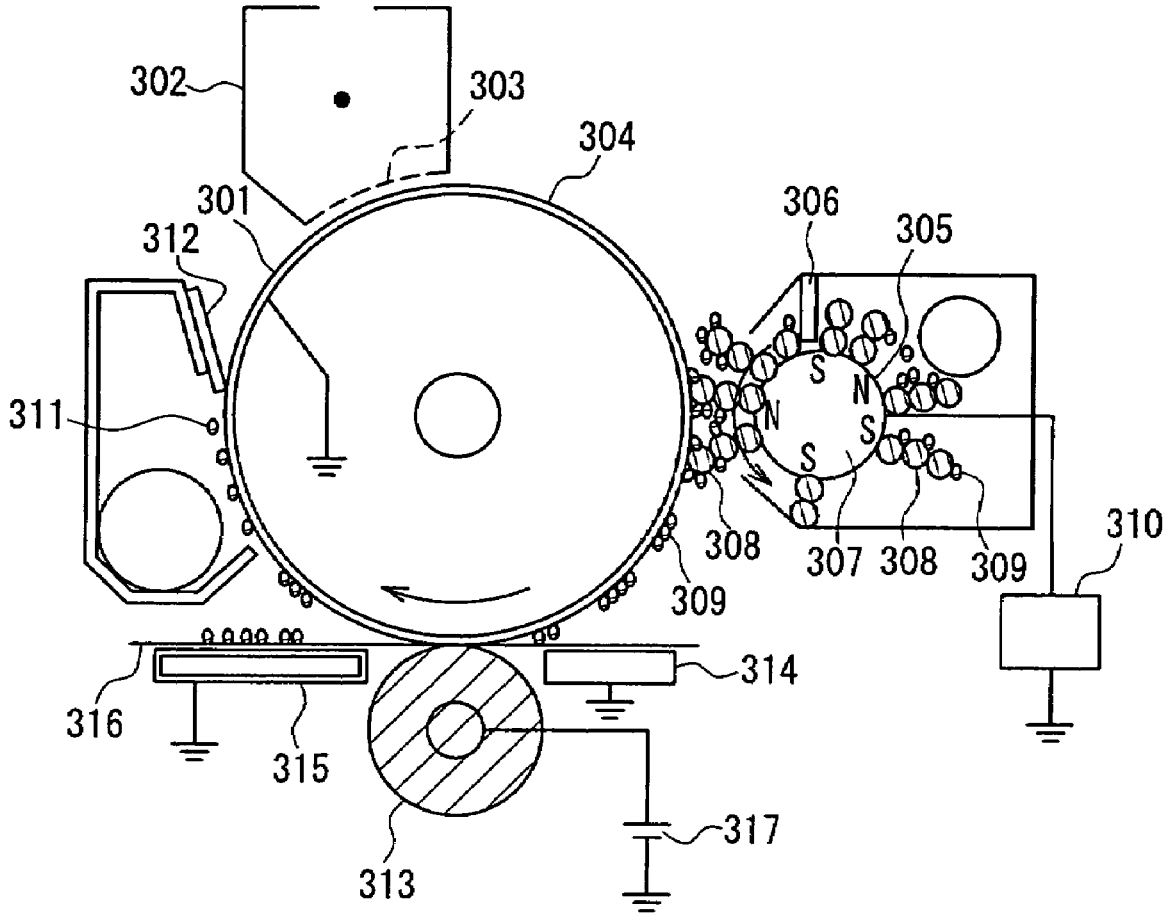
FIG. 1 is a schematic sectional view showing an image forming apparatus that is used in Working Example 1 of the present invention. 301: photosensitive member, 304: laser signal light, 305: development roller, 306: blade, 308: carrier, 309: toner, 310: high voltage power supply

The inventors of the present invention have keenly examined the above-described carrier to improve it, and found the following. In a resin-coated carrier coated with a negatively charged fluorine modified silicone resin containing a positively charged aminosilane coupling agent, the charge amount can increase instantly with respect to toner supplied at the time of printing (charge amount rising characteristics), since the difference on the triboelectric series between the toner and the carrier is reduced, and since the distribution of the charge amounts becomes sharp. Moreover, the resin-coated carrier has a good toner consumption amount and a high durability, since transfer efficiency is excellent based on excellent toner stripping properties. Thus, the present invention was achieved.

In the present invention, it is preferable that the resin coating layer further comprises conductive microparticles within a range of 1 to 15 weight parts with respect to 100 weight parts of the coating resin.

It is preferable that the aminosilane coupling agent is included in a range of 5 to 40 weight parts with respect to 100 weight parts of the coating resin.

Furthermore, it is preferable that the proportion of the coating resin is within a range of 0.1 to 5.0 weight parts with respect to 100 weight parts of the carrier core material.

Furthermore, it is preferable that a releasing agent wax is added to the toner within a range of 4 to 20 weight parts with respect to 100 weight parts of a binding resin of the toner.

Furthermore, it is preferable that inorganic microparticles which have been subjected to a hydrophobic treatment, and whose average particle size ranges from 6 to 120 nm, are adhered on the surface of the toner within a range of 0.5 to 4.5 weight parts with respect to 100 weight parts of the toner.

Hereinafter, the present invention will be described in further detail.

A carrier for electrophotography according to the present invention has a resin coating layer on a carrier core material, the resin coating layer being made of a fluorine modified silicone resin containing an aminosilane coupling agent.

Examples of the carrier core material used in the present invention include an iron powder carrier core material, a ferrite carrier core material, a magnetite carrier core material, and a compound carrier core material. It is preferable to use a ferrite carrier core material since its substantially spherical shape makes it easy to obtain appropriate magnetization properties and electrical resistance properties, which is advantageous in light of providing performance, charge amount rising characteristics, image quality, and a long lifetime.

Herein, the ferrite carrier core material generally can be expressed, for example, by the following formula:

$$(MO)_X(Fe_2O_3)_Y$$

In the formula, M includes at least one selected from Cu, Zn, Fe, Mg, Mn, Ca, Li, Ti, Ni, Sn, Sr, Al, Ba, Co, Mo, and the like. X and Y refer to a molar ratio by weight, and satisfy the condition that X+Y=100.

M preferably includes one or more selected from Li, Mg, Ca, Mn, Sr, and Sn. It is preferable that in the ferrite particles, the content of components other than the above is 1 weight percent or less.

As a raw material, the ferrite carrier core material includes $Fe_2O_3$ as the main component, to which an oxide of M is mixed with M being selected from Cu, Zn, Fe, Mg, Mn, Ca, Li, Ti, Ni, Sn, Sr, Al, Ba, Co, Mo, for example. As an example of a method for producing the ferrite carrier core material, raw materials such as the above oxides are first provided in an appropriate amount, milled by using a wet ball mill for 10 hours, mixed, dried, and then kept at 950° C. for 4 hours. Subsequently, the obtained material is milled by using a wet ball mill for 24 hours, and binding agents such as polyvinyl alcohol, an antifoaming agent, and a dispersing agent are added, so that a slurry with a raw material particle size of 5 μm or less is obtained. This slurry is dried and granulated so as to form a granulated substance, kept at 1300° C. for 6 hours at a controlled oxygen concentration, milled, and then classified to obtain a desired particle size distribution.

As a resin used for a resin coating layer of the present invention, a fluorine modified silicone resin is necessary. It is preferable that the fluorine modified silicone resin is a crosslinked fluorine modified silicone resin obtained by reacting polyorganosiloxane and an organic silicon compound containing a perfluoro alkyl group. It is preferable that the polyorganosiloxane and the organic silicon compound containing a perfluoro alkyl group are mixed so that the organic silicon compound containing a perfluoro alkyl group is present within a range of 3 to 20 weight parts with respect to 100 weight parts of the polyorganosiloxane.

It is preferable that the polyorganosiloxane includes at least one repeating unit selected from Chemical Formulas 1 and 2 below.

Chemical Formula 1

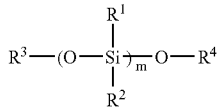

$R^1$ and $R^2$ denote a hydrogen atom, a halogen atom, a hydroxy group, a methoxy group, or a C1 to C4 alkyl group or phenyl group, $R^3$ and $R^4$ denote a C1 to C4 alkyl group or phenyl group, and m denotes an average polymerization degree and is a positive integer, preferably ranging from 2 to 500, and more preferably ranging from 5 to 200.

Chemical Formula 2

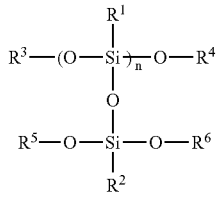

$R^1$ and $R^2$ denote a hydrogen atom, a halogen atom, a hydroxy group, a methoxy group, or a C1 to C4 alkyl group or phenyl group, $R^3$, $R^4$, $R^5$ and $R^6$ denote a C1 to C4 alkyl group or phenyl group, and n denotes an average polymerization degree and is a positive integer, preferably ranging from 2 to 500, and more preferably ranging from 5 to 200.

Examples of the organic silicon compound containing a perfluoro alkyl group include $CF_3CH_2CH_2Si(OCH_3)_3$, $C_4F_9CH_2CH_2Si(CH_3)(OCH_3)_2$, $C_8F_{17}CH_2CH_2Si(OCH_3)_3$, $C_8F_{17}CH_2CH_2Si(OC_2H_5)_3$, and $(CF_3)_2CF(CF_2)_8CH_2CH_2Si(OCH_3)_3$. It is particularly preferable that the organic silicon compound includes a trifluoropropyl group.

Furthermore, in this embodiment, the resin coating layer contains an aminosilane coupling agent. This aminosilane coupling agent may be a known coupling agent such as γ-(2-aminoethyl)aminopropyltrimethoxysilane, γ-(2-aminoethyl) aminopropylmethyldimethoxysilane, and octadecylmethyl [3-(trimethoxysilyl)propyl]ammonium chloride (from the top, SH6020, SZ6023, AY43-021: produced by Dow Corning Toray Silicone Co., Ltd.), and KBM602, KBM603, KBE903, KBM573 (produced by Shin-Etsu Silicones). In particular, primary amines are preferable. The polarity of secondary or tertiary amines having substituents such as a methyl group, an ethyl group, or a phenyl group is so poor that the effect of the charge amount rising characteristics of the toner is small. Furthermore, when the portion of the amino group is an aminomethyl group, an aminoethyl group, or an aminophenyl group, then the silane coupling agent has a primary amine at its end, but the amino groups in the straight-chain organic groups extending from the silane do not affect the charge amount rising characteristics of the toner, but rather are affected by moisture at high humidity, so that even though the carrier has the capability of imparting a charge on the toner initially due to the amino group at the end, this charge imparting capability deteriorates at the time of printing, so that the carrier ultimately will have a short lifetime.

By using such aminosilane coupling agents, a negatively charged developing agent can be obtained in which the charge amount can increase instantly with respect to toner supplied at the time of printing (charge amount rising characteristics) since a negative charge is imparted to the toner while securing a sharp distribution of the charge amounts of the positively charged fluorine modified silicone resin layer, and since a difference on the triboelectric series between the toner and the carrier is reduced, and in which the toner consumption amount is excellent due to the excellent transfer efficiency based on excellent toner stripping properties. Furthermore, the aminosilane coupling agent has an effect that is similar to a crosslinking agent, and thus the crosslinking degree of the fluorine modified silicone resin layer serving as a base layer is improved, reducing abrasion or stripping by a long period of use which generally tends to occur when a fluororesin is used, and the charge is stabilized, thus improving durability.

The aminosilane coupling agent is used within a range of 5 to 40 weight parts, preferably 10 to 30 weight parts, with respect to 100 weight parts of the coating resin. When its content is less than 5 weight parts, the effect of the aminosilane coupling agent cannot be exerted. When its content is more than 40 weight parts, the crosslinking degree of the resin coating layer becomes so high that a charge-up effect tends to occur, and thus image defects such as an insufficient development may be caused.

Furthermore, the coating hardness of a fluorine modified silicone resin having relatively high insulation is improved further by adding an aminosilane coupling agent, and thus abrasion resistance, stripping resistance, and resistance against the formation of spent toner of the resin coating layer are improved, so that sufficient durability for a long period of use, which is one object of the present invention, is secured. However, according to this, the resin coating layer tends to be more insulating, and thus the development properties sometimes are deteriorated. Accordingly, it is preferable that the resin coating layer contains conductive microparticles. Examples of such conductive microparticles include carbon blacks such as oil furnace carbon and acetylene black, semiconductive oxides such as titanium oxide and zinc oxide, and materials in which a surface of powders such as titanium oxide, zinc oxide, barium sulphate, aluminum borate, and potassium titanate are coated with stannic oxide, carbon black, or a metal. It is preferable that the specific resistance thereof is $10^{10}$ Ωcm or less. When the conductive microparticles are used, it is preferable that their content ranges from 1 to 15 weight parts with respect to 100 weight parts of the coating resin. When the content of the conductive microparticles with respect to the resin coating layer is within a certain range, the hardness of the resin coating layer is improved by the filler effect. However, when their content is greater than 15 weight parts, a formation of the resin coating layer is impeded, and thus the adhesiveness or the hardness may be deteriorated. Furthermore, when the conductive microparticles are contained excessively in a full color developing agent, they may cause color stains of the toner to be transferred and adhered on a paper surface. When their content is less than 1 weight part, the effect of reducing the high insulation of the resin coating layer is small, and thus deterioration of the development properties cannot be prevented.

It is preferable that an average particle size of the carrier used in the present invention is 20 to 70 μm. When the average particle size of the carrier is smaller than 20 μm, the ratio of microparticles in the carrier particle distribution becomes high, and thus these carrier particles have low magnetization per particle, so that the carrier tends to be developed too easily on the photosensitive member. Furthermore, when the average particle size of the carrier is more than 70 μm, the specific surface area of the carrier particles becomes small, and thus their toner holding power is reduced, so that toner scattering is caused. Also, in full color development including a large amount of solid image, the solid image is reproduced in a particularly poor manner, which is not preferable. "Solid image" refers to the image in which the toner is printed on a relatively large area. More specifically, it refers to a toner image that has a larger area than a line image such as a letter.

There is no particular limitation regarding the method for forming the coating layer on the carrier core material, and it may include known coating methods of wet coating methods and dry coating methods. Examples of wet coating methods include an immersion method in which a powdered carrier core material is immersed in a solution for forming a coating layer, a spray method in which a solution for forming a coating layer is sprayed onto a surface of a carrier core material, a fluid bed method in which a solution for forming a coating layer is sprayed onto a carrier core material being floated by using fluid air, and a kneader coater method in which a carrier core material and a solution for forming a coating layer are mixed in a kneader coater and then the solvent is removed. In a dry coating method, for example, a powdered resin and a carrier core material are mixed at a high speed, and by using frictional heat generated by this, the powdered resin is fused and coats the surface of the carrier core material. Although any or these methods can be applied, it is particularly preferable to use a wet coating method, when coating a fluorine modified silicone resin containing an aminosilane coupling agent in the present invention.

There is no particular limitation regarding the solvent that is used as a coating liquid for forming a coating layer as long as it dissolves the coating resin, and it may be selected in accordance with a coating resin that is used. Examples of the solvent typically include aromatic hydrocarbons such as toluene and xylene, ketones such as acetone and methyl ethyl ketone, and ethers such as tetrahydrofuran and dioxane.

It is preferable that the content of the coating resin of the present invention ranges from 0.1 to 5.0 weight parts with respect to 100 weight parts of the carrier core material. When the coating resin is less than 0.1 weight parts, it is difficult to form a uniform coating layer on the surface of the carrier, and thus the influence of the characteristics of the carrier core material becomes so dominant that the fluorine modified silicone resin and the aminosilane coupling agent of the present invention may not be sufficiently effective. When its content is more than 5.0 weight parts, the coating layer becomes so thick that the carrier particles granulate with each other, and thus uniform carrier particles may not be obtained.

After coating the surface of the carrier core material with the fluorine modified silicone resin containing the aminosilane coupling agent in this manner, it is preferable to perform a baking process. There is no particular limitation regarding the means for performing the baking process, and it may be either an internal heating process or an external heating process. For example, it is possible to perform the baking process by using an electric furnace with a fixed or a fluidized bed, a rotary kiln electric furnace, a burner furnace, or a microwave furnace. However, regarding the temperature for the baking process, in order to achieve the fluorosilicone's effect of improving resistance against the formation of spent toner of the resin coating layer efficiently, the process is performed at a high temperature preferably ranging from 200 to 350° C., more preferably ranging from 220 to 280° C.

A wax serving as a releasing agent is added to the toner of this embodiment. Examples of the wax preferably include a polyolefin wax such as polyethylene or polypropylene wax, a synthetic hydrocarbon wax such as a paraffin wax, a montan wax or a Fischer-Tropsch wax, and higher fatty acids and their metal compounds, such as stearic acid, palmitic acid, lauric acid, aluminum stearate, barium stearate, zinc stearate, or zinc palmitate. It is preferable to use a wax whose melting point ranges from 60 to 120° C. measured by DSC measurement (with a differential scanning calorimeter). If the melting point is lower than 60° C., high temperature storage properties of the toner are deteriorated, and if the melting point is higher than 120° C., the effect of the fixation offset property is deteriorated. It is preferable that the added amount is within a range of 4 to 20 weight parts with respect to 100 weight parts of the binding resin of the toner. When the added amount is less than the above range, the effect of the fixation offset property is deteriorated. When the added amount is more than the above range, the high temperature storage properties of the toner are deteriorated, and thus fog increases when developing and the transfer efficiency is deteriorated.

Furthermore, as machines perform at higher speeds and are adapted for color printing, it is required that the toner secures a broad margin for a fixation offset and that the developing agent has a longer lifetime. Therefore, it is necessary to add a large amount of wax having a low melting point to the toner. When toner containing a wax having a low melting point is used in combination with a conventional carrier, stirring stress in a developing device causes formation of spent toner on the surface of the carrier within a short period of use, and thus a deterioration of the developing agent is caused. However, by using in combination with the carrier of this embodiment, the formation of spent toner can be prevented, and at the same time, a broad margin for the fixation offset can be secured.

The binding resin of this embodiment contains a polyester resin in which at least one molecular weight maximum peak is in a region of $2\times10^3$ to $3\times10^4$ in a molecular weight distribution measured with GPC, in which the content of components in the high molecular weight region with a molecular weight of at least $3\times10^4$ is at least 5% with respect to the entire binding agent, in which the weight-average molecular weight ranges from 10,000 to 500,000, in which the Z-average molecular weight ranges from 20,000 to 5,000,000, in which the ratio between the weight-average molecular weight and the number-average molecular weight (weight-average molecular weight/number-average molecular weight) ranges from 3 to 150, in which the ratio between the Z-average molecular weight and the number-average molecular weight (Z-average molecular weight/number-average molecular weight) ranges from 10 to 2000, in which the melting temperature (hereinafter, referred to as the softening point) ranges from 80 to 150° C. measured by the ½ method with a capillary rheometer flow-tester of a constant pushing force type, in which the flow-beginning temperature ranges from 80 to 120° C., and in which the glass transition point of the resin ranges from 45 to 68° C. The resin preferably contains a polyester resin in which the weight-average molecular weight ranges from 10,000 to 150,000, in which the Z-average molecular weight ranges from 20,000 to 4,000,000, in which the ratio of (weight-average molecular weight)/(number-average molecular weight) ranges from 3 to 50, in which the ratio of (Z-average molecular weight)/(number-average molecular weight) ranges from 10 to 1500, in which the softening point ranges from 90 to 140° C., in which the flow-beginning temperature ranges from 85 to 115° C., and in which the glass transition point ranges from 52 to 65° C. The resin more preferably contains a polyester resin in which the weight-average molecular weight ranges from 10,000 to 120,000, in which the Z-average molecular weight ranges from 100,000 to 3,200,000, in which the ratio of (weight-average molecular weight)/(number-average molecular weight) ranges from 3 to 20, in which the ratio of (Z-average molecular weight)/(number-average molecular weight) ranges from 10 to 1000, in which the softening point ranges from 105 to 135° C., in which the flow-beginning temperature ranges from 90 to 120° C., and in which the glass transition point ranges from 58 to 65° C.

When using a binding resin in which the weight-average molecular weight is smaller than 10,000, in which the Z-average molecular weight is smaller than 20,000, in which the ratio of (weight-average molecular weight)/(number-average molecular weight) is smaller than 3, in which the ratio of (Z-average molecular weight)/(number-average molecular weight) is smaller than 10, in which the softening point is lower than 80° C., in which the flow-beginning temperature is lower than 80° C., or in which the glass transition point is lower than 45° C., then the dispersibility of the wax or the electric charge controlling agent in the resin is deteriorated, and thus fog or toner scattering increases, offset resistance or high temperature storage properties are deteriorated, and filming on a photosensitive member occurs.

When using a binding resin in which the weight-average molecular weight is larger than 500,000, in which the Z-average molecular weight is larger than 5,000,000, in which the ratio of (weight-average molecular weight)/(number-average molecular weight) is larger than 150, in which the ratio of (Z-average molecular weight)/(number-average molecular weight) is larger than 2000, in which the softening point is higher than 150° C., in which the flow-beginning temperature is higher than 120° C., or in which the glass transition point is higher than 68° C., then an excessive load may be applied during processing in the device, and thus the productivity decreases extremely or the adhesive strength decreases.

The binding resin that preferably is used in this embodiment is a polyester resin obtained by a condensation polymerization between an alcohol component and a carboxylic acid component such as carboxylic acid, carbonate, or carboxylic anhydride.

Examples of dibasic carboxylic acids or lower alkyl esters include aliphatic dibasic acids such as malonic acid, succinic acid, glutaric acid, adipic acid, and hexahydrophthalic anhydride, aliphatic unsaturated dibasic acids such as maleic acid, maleic anhydride, fumaric acid, itaconic acid, and citraconic acid, aromatic dibasic acids such as phthalic anhydride, phthalic acid, terephthalic acid, and isophthalic acid, and their methyl ester and ethyl ester. Of these, it is preferable to use aromatic dibasic acid or their lower alkyl ester such as succinic acid, phthalic acid, terephthalic acid, or isophthalic acid. It is preferable to use succinic acid and terephthalic acid together, or to use phthalic acid and terephthalic acid together.

Examples of tribasic or higher carboxylic acid components include 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexatricarboxylic acid, 1,3-dicarboxylic-2-methyl-2-methylene carboxpropane, tetra(methylene carboxyl) methane, 1,2,7,8-octanetetracarboxylic acid, pyromellitic acid, Enpol trimer acid and their acid anhydrides and alkyl (C1 to C12) esters.

Examples of the dihydric alcohol include diols such as ethylene glycol, 1,2-propylene glycol, 1,3-propylene glycol, 1,3-butylene glycol, 1,4-butylene glycol, 1,6-hexanediol, neopentyl glycol, diethylene glycol, dipropylene glycol, bisphenol A ethylene oxide additive, and bisphenol A propylene oxide additive, triols such as glycerin, and trimethylolpropane, trimethylolethane, and mixtures of these. Of these, it is particularly preferable to use a bisphenol A as shown in Chemical Formula 3, its derivatives, its alkylene oxide additives, neopentyl glycol, or trimethylolpropane.

Chemical Formula 3

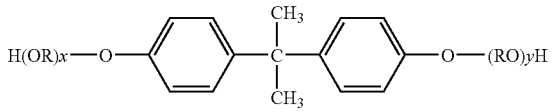

R denotes an ethylene group or a propylene group, and x and y respectively denote an integer that is 1 or larger, and the average value of x+y ranges from 2 to 10.

Examples of a trihydric or higher alcohol component include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethyl benzene.

The polymerization may be performed by a known process, such as condensation polymerization or solution condensation polymerization. Thus, a superior toner can be obtained without damaging PVC mat resistance or the color of a coloring material of a color toner.

Polybasic carboxylic acid and polyhydric alcohol typically are used in such a proportion that the ratio of hydroxyl groups to carboxyl groups (OH/COOH) by number ranges from 0.8 to 1.4.

The molecular weights of the resin, wax, and toner are values obtained by measurements using gel permeation chromatography (GPC) using a plurality of kinds of monodisperse polystyrene as the standard sample.

The measurement is performed by using an apparatus of the HPLC8120 series (produced by Tosoh Corporation); with columns of TSKgel superHM-H H4000/H3000/H2000 (diameter: 7.8 mm, 150 mm×3); with an eluent of THF (tetrahydrofuran) at a flow-rate of 0.6 ml/min, a sample concentration of 0.1%, and an added amount of 20 μL; with a detector of RI; and at a measuring temperature of 40° C. As a pretreatment, a sample is dissolved in THF and filtered through a filter of 0.45 μm to remove additives such as silica from the sample. Subsequently, the obtained resin component is measured. The measurement is performed under the condition that the molecular weight distribution of the sample to be measured is included within a range in which a straight line is formed by the count number and the logarithm of the molecular weight in the measuring curve obtained by a plurality of monodisperse polystyrene standard samples.

Furthermore, the softening point of the binding resin is measured as follows by using a flow-tester (produced by Shimadzu corporation: CFT500). While heating 1 $cm^3$ of a sample at a temperature-increase rate of 6° C./min, a load of approximately $9.8\times10^5$ $N/m^2$ is applied by a plunger to extrude the sample from a die having a diameter of 1 mm and a length of 1 mm. Based on the relationship between the piston stroke of this plunger and the temperature rising properties, a flow-beginning temperature (Tfb) is a temperature when the piston stroke starts to rise. According to the ½ method, the melting temperature (softening point Tm) is the temperature at a point obtained by adding the lowest value in the curve to the ½ value of a difference between the lowest value of the curve and the flow ending point.

The glass transition point of the resin is measured by using a differential scanning calorimeter. A sample is heated to 100° C. and is kept at the same temperature for 3 minutes. Subsequently, the sample is cooled to room temperature at a temperature-falling rate of 10 K/min, and then is heated at a temperature-increase rate of 10 K/min. Based on a heat history measured at that time, "glass transition point" refers to the temperature at a point of intersection between an extension line of a base line below the glass transition point and a tangent line having the maximum inclination in a range of a peak rising portion to the peak top.

According to the DSC measurement, the melting point in an endothermic peak is measured by using a differential scanning calorimeter DSC-50 (produced by Shimadzu Corporation). A sample is heated to 200° C. at a temperature-increase rate of 5 K/min and is kept at the same temperature for 5 minutes. Subsequently, the sample is quickly cooled to 10° C. and is left for 15 minutes. Then the sample is heated at a temperature-increase rate of 5 K/min. Based on an endothermic (melting) peak measured at that time, the melting point is obtained. The amount of the sample placed into a cell is 10 mg±2 mg.

Preferable examples of the binding resin used in this embodiment also may include a monopolymer and a copolymer of various kinds of vinyl monomers. For example, styrene and its derivatives such as styrene, o-methylstyrene, m-methylstyrene, p-methylstyrene, p-ethylstyrene, 2,4-dimethyistyrene, p-n-butylstyrene, p-tert-butylstyrene, p-n-hexylstyrene, p-n-octylstyrene, and p-chlorostyrene may be used, and it is particularly preferable to use styrene.

Examples of acrylic monomer include acrylic acid, methacrylic acid, methyl acrylate, ethyl acrylate, butyl acrylate, 2-ethylhexyl acrylate, cyclohexyl acrylate, phenyl acrylate, methyl methacrylic acid, hexyl methacrylic acid, 2-ethylhexyl methacrylic acid, β-hydroxyethyl acrylate, γ-hydroxypropyl acrylate, a-hydroxybutyl acrylate, β-hydroxyethyl methacrylic acid, γ-aminopropyl acrylate, γ-N,N-diethylaminopropyl acrylate, ethylene glycol dimethacrylic acid ester, and tetraethylene glycol dimethacrylic acid ester. In light of the objects of the present invention, a styrene-acrylic copolymer is preferably a copolymer of styrene and butyl acrylate, more preferably a copolymer that contains 75 to 85 weight percent of styrene and 15 to 25 weight percent of butyl acrylate.

At that time, it is preferable that the weight-average molecular weight ranges from 30,000 to 400,000, that the Z-average molecular weight ranges from 50,000 to 5,000,000, that the ratio of (weight-average molecular weight)/(number-average molecular weight) ranges from 10 to 100, that the ratio of (Z-average molecular weight)/(number-average molecular weight) ranges from 40 to 2000, that the softening point ranges from 90 to 140° C., and that the flow-beginning temperature ranges from 85 to 115° C., and that the glass transition point ranges from 52 to 65° C. It is more preferable that the weight-average molecular weight ranges from 30,000 to 280,000, that the Z-average molecular weight ranges from 50,000 to 3,000,000, that the ratio of (weight-average molecular weight)/(number-average molecular weight) ranges from 10 to 50, that the ratio of (Z-average molecular weight)/(number-average molecular weight) ranges from 40 to 500, that the softening point ranges from 105 to 135° C., and that the flow-beginning temperature ranges from 90 to 120° C., and that the glass transition point ranges from 58 to 65° C.

When using a binding resin in which the weight-average molecular weight is smaller than 30,000, in which the Z-average molecular weight is smaller than 50,000, in which the ratio of (weight-average molecular weight)/(number-average molecular weight) is smaller than 10, in which the ratio of (Z-average molecular weight)/(number-average molecular weight) is smaller than 40, in which the softening point is lower than 90° C., in which the flow-beginning temperature is lower than 85° C., or in which the glass transition point is lower than 52° C., then the dispersibility of the wax or the electric charge controlling agent in the resin is deteriorated, and thus fog or toner scattering increases, offset resistance or high temperature storage properties are deteriorated, and filming on a photosensitive member occurs.

When using a binding resin in which the weight-average molecular weight is larger than 400,000, in which the Z-average molecular weight is larger than 5,000,000, in which the ratio of (weight-average molecular weight)/(number-average molecular weight) is larger than 100, in which the ratio of (Z-average molecular weight)/(number-average molecular weight) is larger than 2000, in which the softening point is higher than 140° C., in which the flow-beginning temperature is higher than 120° C., or in which the glass transition point is higher than 65° C., then an excessive load may be applied during processing in the device, and thus the productivity decreases extremely or the adhesive strength decreases.

As the method for producing the polymer, it is possible to use any known polymerization method, such as bulk polymerization, block polymerization, liquid polymerization, suspension polymerization, or emulsion polymerization. It is also preferable to use a method, for example, in which polymerization is performed up to a conversion ranging from 30 to 90 weight parts using bulk polymerization, and then to add a solvent and a polymerization initiator, and to continue the reaction using liquid polymerization.

Examples of a pigment used in this embodiment include carbon black, iron black, graphite, nigrosine, a metal complex of azo dye, acetoacetic arylamido mono azo yellow pigment such as C.I. pigment yellow 1, 3, 74, 97, or 98, acetoacetic arylamido dis-azo yellow pigment such as C.I. pigment yellow 12, 13, 14, or 17, C.I. solvent yellow 19, 77, or 79, and C.I. disperse yellow 164. It is particularly preferable to use benzimidazolone such as C.I. pigment yellow 93, 180, or 185, in light of an effect regarding filming on a photosensitive member.

One or more kinds selected from red pigments such as C.I. pigment red 48, 49:1, 53:1, 57, 57:1, 81, 122, or 5, red dyes such as C.I. solvent red 49, 52, 58, or 8, and blue dye or pigment of phthalocyanine or its derivatives such as C.I. pigment blue 15:3 is/are added. The added amount is preferably within a range of 3 to 8 weight parts with respect to 100 weight parts of the binding resin.

Examples of an external additive of this embodiment include metal-oxide fine powders such as silica, alumina, titanium oxide, zirconia, magnesia, ferrite, or magnetite, titanates such as barium titanate, calcium titanate, or strontium titanate, zirconates such as barium zirconate, calcium zirconate, or strontium zirconate, and mixtures of these. If necessary, a hydrophobic treatment is performed on the external additive.

Examples of a silane coupling agent for the hydrophobic treatment include dimethyldichlorosilane, trimethylchlorosilane, allyldimethylchlorosilane, hexamethyldisilazane, allyl phenyl dichlorosilane, benzyl methylchlorosilane, vinyl triethoxy-silane, y-methacrylic oxypropyltrimethoxysilane, vinyltriacetoxy silane, divinylchlorosilane and dimethyl vinylchlorosilane. Examples of the treatment with the silane coupling agent include a dry treatment in which an evaporated silane coupling agent is reacted with microparticles put into a cloud state by, for example, stirring, and a wet treatment in which a dropping reaction is performed with a silane coupling agent containing microparticles dispersed in its solvent.

Furthermore, it is also preferable to perform a treatment with a silicone oil material after the treatment with the silane coupling agent.

In order further to enhance the effect of the hydrophobic treatment, it is preferable to perform an additional treatment with hexamethyldisilazane, dimethyldichlorosilane, or other silicone oil. It is preferable to perform the treatment with at least one of dimethyl silicone oil, methylphenyl silicone oil, and alkyloyl modified silicone oil.

It is preferable that inorganic microparticles having an average particle size of 6 nm to 120 nm are added within a range of 0.5 to 4.5 weight parts with respect to 100 weight parts of the toner host particles. When the average particle size is smaller than 6 nm, floating of silica or filming on a photosensitive member tends to occur, and back transfer while transferring cannot be completely suppressed. When the average particle size is larger than 120 nm, the fluidity of the toner is deteriorated. When the added amount is smaller than 0.5 weight parts, the fluidity of the toner is deteriorated, and an occurrence of transfer defects while transferring cannot be suppressed completely. When the added amount is larger than 4.5 weight parts, floating of silica or filming on a photosensitive member tends to occur.

Hereinafter, the present invention will be described in further detail with reference to working examples. However, the present invention is not limited to these.

WORKING EXAMPLES

Carrier Production Example 1

First, 39.7 mol percent of MnO, 9.9 mol percent of MgO, 49.6 mol percent of $Fe_2O_3$, and 0.8 mol percent of SrO were milled for 10 hours using a wet ball mill, mixed, dried, and pre-baked by keeping at 950° C. for 4 hours. Subsequently, the obtained material was milled using the wet ball mill for 24 hours, granulated using a spray dryer, dried, and baked by keeping in an electric furnace in an atmosphere of 2% oxygen concentration at 1270° C. for 6 hours. Then, the material was cracked and further classified, so as to obtain a core material made of ferrite particles whose average particle size was 50 μm, and in which the saturation magnetization was 65 emu/g when a magnetic field of 3000 oersted was applied.

Next, 250 g of polyorganosiloxane including 15.4.mol percents of $(CH_3)_2SiO$ units shown in Chemical Formula 4 below and 84.6 mol percents of $CH_3SiO_{3/2}$ units shown in Chemical Formula 5 below were reacted with 21 g of $CF_3CH_2CH_2Si(OCH_3)_3$, and a fluorine modified silicone resin was obtained. This is a demethoxylation reaction in which an organic silicon compound molecule containing a perfluoro alkyl group is introduced to the polyorganosiloxane. Furthermore, 100 g of this fluorine modified silicone resin on the solid basis and 10 g of an aminosilane coupling agent (γ-aminopropyltriethoxysilane) were weighed, and were dissolved in 300 cc of toluene solvent.

Chemical Formula 4

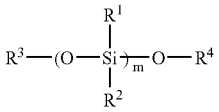

$R^1$, $R^2$, $R^3$, and $R^4$ denote a methyl group, and m denotes an average polymerization degree and is 100.

Chemical Formula 5

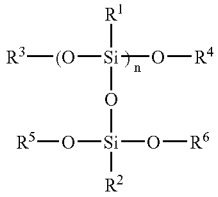

$R^1$, $R^2$, $R^3$, $R^4$, $R^5$, and $R^6$ denote a methyl group, and n denotes an average polymerization degree and is 80.

Subsequently, 10 kg of the above-described ferrite particles were coated by stirring them in the above-described coating resin solution for 20 minutes using immersion dry coating equipment. Subsequently, the obtained material was baked at 260° C. for 1 hour, and carrier 1 was obtained.

Carrier Production Example 2

A core material was produced and coated by the same processes as in Carrier Production Example 1 except that the $CF_3CH_2CH_2Si(OCH_3)_3$ was changed to $C_8F_{17}CH_2CH_2Si(OCH_3)_3$, and carrier 2 was obtained.

Carrier Production Example 3

A core material was produced and coated by the same processes as in Carrier Production Example 1 except that conductive carbon (produced by Ketjenblack International Company: EC) was dispersed at a ratio of 5% with respect to the solid compound of the resin by using a pearl mill, and carrier 3 was obtained.

Carrier Production Example 4

A core material was produced and coated by the same processes as in Carrier Production Example 3 except that the amount of the added aminosilane coupling agent was changed to 5 g, and carrier 4 was obtained.

Carrier Production Example 5

A core material was produced and coated by the same processes as in Carrier Production Example 3 except that the amount of the added aminosilane coupling agent was changed to 30 g, and carrier 5 was obtained.

Carrier Production Example 6

A core material was produced and coated by the same processes as in Carrier Production Example 3 except that the amount of the added aminosilane coupling agent was changed to 50 g, and carrier 6 was obtained.

Carrier Production Example 7

A core material was produced and coated by the same processes as in Carrier Production Example 1 except that the coating resin was changed to a straight silicone resin (produced by Dow Corning Toray Silicone Co., Ltd.: SR-2411), and carrier 7 was obtained.

Carrier Production Example 8

A core material was produced and coated by the same processes as in Carrier Production Example 7 except that conductive carbon (produced by Ketjenblack International Company: EC) was dispersed at a ratio of 5% with respect to the solid compound of the resin by using a pearl mill, and carrier 8 was obtained.

Carrier Production Example 9

A core material was produced and coated by the same processes as in Carrier Production Example 1 except that the coating resin was changed to a copolymer of perfluoro octylethylethyl acrylate and methacrylate, and carrier 9 was obtained.

Carrier Production Example 10

A core material was produced and coated by the same processes as in Carrier Production Example 1 except that the coating resin was changed to an acrylic modified silicone resin (produced by Shin-Etsu Chemical Co., Ltd.: KR-9706), and carrier 10 was obtained.

Working Example 1

A toner is produced through a preliminary mixing process, a melting and kneading process, a milling and classifying process, and an external adding process. In the preliminary mixing process, a binding resin and an additive to be dispersed into this resin are dispersed in a uniform manner by using, for example, a mixer provided with a stirring blade. Examples of such a mixer include known mixers such as a Super Mixer (produced by Kawata Manufacturing Co., Ltd.), a Henschel Mixer (produced by Mitsui Mining Co., Ltd.), a PS mixer (produced by Shinko Pantec Co., Ltd.), and a Lodige Mixer.

In the kneading process, a twin-screw extruding kneader (produced by Ikegai Co., Ltd.: PCM45) is preferably used. The kneaded material is roughly milled by using, for example, a cutter mill, and is finely milled by using, for example, a jet mill (produced by Nippon Pneumatic Mfg. Co., Ltd.: IDS mill, for example). Subsequently, the obtained microparticles are omitted by using a pneumatic classifier, if necessary, and toner particles (toner host particles) with desired particle size distribution are obtained. In the classifying process, toner particles (toner host particles) with a volume average particle size of 8 μm were obtained.

In the external adding process, the toner particles (the toner host particles) obtained through the classification process are mixed with an external additive such as silica. A known mixer such as a Henschel Mixer or a Super Mixer is used for this process.

Table 1 below shows characteristics of the binding resin used in this working example. Resins JE-1 and JE-2 were a polyester resin containing bisphenol A propylene oxide additive, terephthalic acid, trimellitic acid, succinic acid, and fumaric acid as the main components, whose thermal characteristics and mix proportion were varied by the polymerization conditions. Resins JS-1, JS-2, and JS-3 are copolymers of styrene and butylacryl acid, whose thermal characteristics and mix proportion were varied.

TABLE 1

| resin | JE-1 | JE-2 | JS-1 | JS-2 | JS-3 |
|---|---|---|---|---|---|
| Mn ($\times 10^4$) | 0.32 | 0.31 | 0.59 | 0.52 | 0.32 |
| Mw ($\times 10^4$) | 6.40 | 10.20 | 18.50 | 25.50 | 4.20 |
| Mz ($\times 10^4$) | 97.50 | 302.50 | 189.20 | 250.50 | 82.10 |

TABLE 1-continued

| resin | JE-1 | JE-2 | JS-1 | JS-2 | JS-3 |
|---|---|---|---|---|---|
| Wm = Mw/Mn | 20.00 | 31.88 | 31.36 | 48.65 | 13.13 |
| Wz = Mz/Mn | 304.69 | 945.31 | 320.68 | 481.73 | 256.56 |
| Tg (° C.) | 58.00 | 63.00 | 59.80 | 62.80 | 58.00 |
| Tm (° C.) | 119.80 | 121.50 | 130.50 | 135.40 | 107.00 |
| Tfb (° C.) | 100.00 | 105.40 | 112.50 | 110.50 | 890.00 |
| AV (mg KOH/g) | 15 | 20 | 3 | 6 | 1 |

Mn denotes number-average molecular weight, Mw denotes weight-average molecular weight, Mz denotes Z-average molecular weight, Wm denotes the ratio between the weight-average molecular weight Mw and the number-average molecular weight Wn (Mw/Mn), Wz denotes the ratio between the Z-average molecular weight Mz and the number-average molecular weight Mn of the binding resin (Mz/Mn), and AV denotes a resin acid value. Table 2 below lists the waxes used in this working example.

TABLE 2

| wax | material | product name (manufacturer name) |
|---|---|---|
| WA-1 | polypropylene wax | VISCOL 550P (Sanyo Chemical Industries, Ltd.) |
| WA-2 | polyethylene wax | LEL 400P (Sanyo Chemical Industries, Ltd.) |

As a pigment in this working example, Carbon Black #40 (produced by Mitsubishi Chemical Co., Ltd.) was used at a ratio of 5 weight parts with respect to 100 weight parts of the binding resin.

The external additive used in this working example was R974 (16 nm, treated with dimethyldichlorosilane) and RX50 (40 nm, treated with hexamethyldisilazane) both of which were produced by Nippon Aerosil Co., Ltd. Their contents were 1.0 weight parts each with respect to 100 weight parts of the toner host particles. The external adding process was performed by using a stirring blade Z0S0-type of FM20B, at a revolving speed of 2000 $min^{-1}$, at a processing time of 5 minutes, and at a loading amount of 1 kg.

Table 3 below shows toner material compositions and carriers used in this working example.

TABLE 3

| toner | resin | wax | carrier | developing agent |
|---|---|---|---|---|
| T1 | JE1 | WA1 (5) | carrier 1 | D1 |
| T2 | JE2 | WA2 (15) | carrier 2 | D2 |
| T3 | JE1 | WA1 (7) | carrier 3 | D3 |
| T4 | JE2 | WA2 (6) | carrier 4 | D4 |
| T5 | JS1 | WA1 (18) | carrier 5 | D5 |
| T6 | JS2 | WA2 (15) | carrier 1 | D6 |
| T1 | JE1 | WA1 (5) | carrier 6 | d7 |
| T7 | JS3 | WA2 (12) | carrier 7 | d8 |
| T2 | JE2 | WA2 (15) | carrier 8 | d9 |
| T8 | JS1 | WA1 (15) | carrier 9 | d10 |
| T3 | JE1 | WA1 (7) | carrier 10 | d11 |

As a mix proportion by weight of the waxes, a ratio of an added amount (weight parts) with respect to 100 weight parts of the binding resin is shown in parenthesis.

FIG. 1 is a cross-sectional view showing the structure of an electrophotographic apparatus used in this working example. The apparatus in this working example is a modified FPD605 copier (produced by Matsushita Electric Industrial Co., Ltd.). The mixing proportion between toner and carrier was 92:8.

An organic photosensitive member 301 has an aluminum conductive supporting material, on which a charge-generating layer is formed by vapor-depositing oxotitanium phthalocyanine powder, on which a charge-transporting layer including a mixture of a polycarbonate resin (produced by Mitsubishi Gas Chemical Company, Inc.: Z-200), butadiene, and hydrazone is further layered in this order. Numeral 302 denotes a corona charger for charging the photosensitive member negatively, numeral 303 denotes a grid electrode for controlling charge potential of the photosensitive member, and numeral 304 denotes a signal light. Numeral 305 denotes a development sleeve, numeral 306 denotes a magnetic doctor blade, numeral 307 denotes a magnet roller for holding a carrier, numeral 308 denotes a carrier, numeral 309 denotes a toner, numeral 310 denotes a voltage generator, numeral 311 denotes a waste toner left after transfer, and numeral 312 denotes a cleaning rubber elastic blade. It is preferable that a gap between the development sleeve and the magnetic doctor blade ranges from 0.3 to 0.5 mm, and that a gap between the development sleeve and the photosensitive member ranges from 0.2 to 0.5 mm. In this working example, the former was set to 0.3 mm and the latter was set to 0.4 mm. The amount of the developing agent that was used is 600 g.

Numeral 313 denotes a transfer roller for transferring a toner image on the photosensitive member to paper, in which a surface of the roller is brought into contact with a surface of the photosensitive member 301. The transfer roller 313 is an elastic roller in which a conductive elastic member is provided around a shaft made of a conductive metal. A pressing force applied to the photosensitive member 301 by the one transfer roller 313 (approximately 216 mm) ranges from 0 to 2000 g, and preferably ranges from 500 to 1000 g. The force was measured from a value obtained by multiplying a spring coefficient by a shrinking amount of a spring for applying a force so that the transfer roller 313 is brought into contact with the photosensitive member 301. A contact width with the photosensitive member 301 ranges from approximately 0.5 mm to 5 mm. The rubber hardness of the transfer roller 313 measured according to Asker C (a measurement by using a block piece instead of a roller form) is 80 degrees or less, and preferably ranges from 30 to 40 degrees. The elastic roller 313 was formed of urethane elastomer in which lithium salt such as $Li_2O$ salt was internally added around the shaft having a diameter of 6 mm, so that its resistance value was $10^6$ to $10^8\Omega$ (the shaft and the surface were provided with an electrode to which a voltage of 500 V was applied). The outer diameter of the entire transfer roller 313 was 16.4 mm, and the hardness measured according to Asker C was 40 degrees. The transfer roller 313 was brought into contact with the photosensitive member 301 by pressing the shaft of the transfer roller 313 with the metal spring. The pressing force was approximately 1000 g. Examples of the elastic body for the roller include not only the above-described foamed urethane elastomer but also an elastic body made of another material such as CR rubber, NBR, Si-rubber, or fluororubber. Examples of the conductivity imparting agent for imparting conductivity include not only the above-described lithium salt but also another conductive material such as carbon black. Numeral 314 denotes an entry guide made of a conductive member for sending transfer paper to the transfer roller 313, and numeral 315 denotes a conveying guide in which a surface of a conductive member is coated for insulation. The entry guide 314 and the conveying guide 315 are grounded directly or via a resistor. Numeral 316 denotes transfer paper, and numeral 317 denotes a voltage generating power source for applying a voltage to the transfer roller 313.

The photosensitive member 301 having a diameter of 60 mm, was rotated in the direction indicated by the arrow in FIG. 1 at a circumferential speed of 360 mm/s. The photosensitive member 301 was charged to −700 V by using the corona charger 302 (applied voltage: −4.5 kV, voltage of grid 303: −700 V). This photosensitive member 301 was irradiated with the signal light 304 to form an electrostatic latent image. At that time, an exposure potential of the photosensitive member 301 was −100 V. The toner 309 was developed on the surface of this photosensitive member 301.

An image was developed by using the above-described image forming apparatus. Table 4 below shows a result of a durability test.

TABLE 4

| toner | carrier No. | developing agent | Spent amount (%) | stripping amount (%) | carrier resistance change rate (%) | charge amount on toner (μC/g) initial stage | after 1 million sheets | transfer efficiency (%) |
|---|---|---|---|---|---|---|---|---|
| T1 | 1 | D1 | 1.7 | 1.3 | 1.6 | −32.9 | −30.2 | 92.5 |
| T2 | 2 | D2 | 1.5 | 1.0 | 1.8 | −30.8 | −26.8 | 91.5 |
| T3 | 3 | D3 | 1.2 | 1.2 | 1.7 | −25.8 | −21.9 | 90.2 |
| T4 | 4 | D4 | 1.5 | 2.3 | 2.1 | −28.5 | −24.9 | 90.8 |
| T5 | 5 | D5 | 1.5 | 0.9 | 1.4 | −35.2 | −32.8 | 92.0 |
| T6 | 1 | D6 | 1.6 | 1.5 | 1.6 | −39.8 | −36.4 | 92.8 |
| T1 | 6 | d7 | 2.0 | 1.1 | 1.5 | −45.5 | −52.8 | 61.7 |
| T7 | 7 | d8 | 4.5 | 5.2 | 18.0 | −24.6 | −11.8 | 62.5 |
| T2 | 8 | d9 | 4.2 | 5.2 | 20.5 | −18.5 | −10.2 | 59.5 |
| T8 | 9 | d10 | 3.8 | 6.7 | 16.0 | −25.8 | −10.5 | 63.5 |
| T3 | 10 | d11 | 5.0 | 5.8 | 32.4 | −19.4 | −9.8 | 61.5 |

The charge amount was measured by a blow-off method for triboelectric charging with a ferrite carrier. For the durability test, 0.3 g of samples were collected at a temperature of 25° C. and a relative humidity of 45% RH, and were blown with nitrogen gas at $1.96\times10^4$ (Pa) for 1 minute.

The spent amount (the spent effect of the toner) and the stripping amount (stripping of a resin coating layer) were calculated as follows.

First, a reflected electron image was picked up by using an electron microscope (produced by JEOL Ltd.: JSM-6100) at an applied voltage of 5 kV. This image was read by a scanner, and was transformed into an image only of carrier particles by using image analysis software (produced by Media Cybernetics: Image-Pro Plus). Subsequently, a ternary coding process was performed to divide the image into a white portion (a portion of core material exposed), a black portion (a spent portion), and a gray portion (a coating resin portion), and then the respective areas were calculated. By using these values, a spent area ratio (ratio of toner spent occupying the surface of the carrier) and a coating resin area ratio (ratio of the coating resin occupying the surface of the carrier) were calculated based on the following formulas.

Spent area ratio (%)={black portion area/(white portion area+black portion area+gray portion area)}

Coating resin area ratio (%)={gray portion area/(white portion area+black portion area+gray portion area)}

By using the above formulas, the area ratios of carriers of the initial stage and after the durability test were calculated, and the spent amount and the stripping amount were obtained as differences in the area ratio between the carrier at the initial stage and the carrier after the durability test.

Spent amount (%)=(spent area ratio of carrier after durability test)−(spent area ratio of carrier at initial stage)

Stripping amount (%)=(coating resin area ratio of carrier after durability test)−(coating resin area ratio of carrier at initial stage)

It is preferable that the spent amount is 2.0% or less, and that the stripping ratio is 3.0% or less.

The rate of the carrier resistance change was calculated as follows.

The carrier resistance was measured in a state in which 200 mg of a carrier as a sample was inserted into a gap between electrodes of 2.0 mm, in which a magnetic field having a surface flux density of 1600 gauss was activated, in which carriers were connected in a linear manner, and in which a dc voltage of 500 V was applied. Next, by using the above-described method, the resistance of the carrier at the initial stage and the carrier after the durability test was measured, and the rate of carrier resistance change was calculated based on the following formula:

Rate of carrier resistance change(%)=(carrier resistance of carrier after durability test)/(carrier resistance of carrier at initial stage)

It is preferable that the rate of carrier resistance change ranges from 0.1 to 10%.

When an image was developed by using the developing agents D1 to D5, the obtained image achieved extremely high definition and high image quality in which, for example, a disturbance in horizontal line, toner scattering, or letter missing was not caused, in which a solid black image was reproduced uniformly, and in which even 16 lines/mm were reproduced. Furthermore, the obtained image achieved a high image density of 1.3 or more. In addition, surface fog at a non-image portion was not caused. Even in a long-period durability test using one million sheets of A4-sized paper, stable characteristics were shown in which changes in the charge amount and the image density tended not to occur. Furthermore, the uniformity was excellent when a whole-surface solid image was developed. A development memory was not generated. The transfer efficiency was 90% or more. In addition, stable characteristics were shown in which the charge amount tended not to decrease at high temperature or high humidity, and in which the charge amount did not tend to change at low temperature or low humidity.

However, when an image was developed by using the developing agent d6, a charge-up was drastic, and the charge amount increased, so that the image density was extremely reduced.

Furthermore, when an image was developed by using the developing agents d7 to d11, fusion of toner to the carrier tended to occur, carrier resistance changed significantly, the charge amount tended to decrease, and fog tended to increase. The charge amount decreased at high temperature or high humidity, so that fog increased. The charge amount increased at low temperature or low humidity, so that the image density was reduced. The transfer efficiency was decreased to approximately 60%.

INDUSTRIAL APPLICABILITY

The present invention provides a carrier for electrophotography having a high durability and a long lifetime, in which the charge amount does not decrease at high temperature or high humidity nor extremely increase at low temperature or low humidity, in which a deterioration of a developing agent caused by stripping of a coating layer is prevented, and in which a deterioration caused by formation of spent toner of a toner is also prevented, by coating a surface of a core material with a coating resin containing a fluorine modified silicone resin and an aminosilane coupling agent as described above.

The invention claimed is:

1. A two-component developer comprising:

a carrier for electrophotography in which a surface of at least a core material is coated with a resin; and a toner, wherein the coating resin contains a fluorine modified silicone resin and an aminosilane coupling agent, wherein the aminosilane coupling agent is included in a range of 5 to 40 weight parts with respect to 100 weight parts of the coating resin, wherein the fluorine modified silicone resin is a crosslinked fluorine modified silicone resin obtained by reacting an organic silicon compound containing a perfluoro alkyl group with polyorganosiloxane within a range of 3 to 20 weight parts with respect to 100 weight parts of the polyorganosiloxane, wherein the toner contains (1) a binding resin and (2) wax, and is charged negatively, wherein the binding resin includes a polyester resin in which at least one molecular weight maximum peak is in a region of $2\times10^3$ to $3\times10^4$ in a molecular weight distribution measured with gel permeation chromatography, in which the content of components in a high molecular weight region with a molecular weight of at least $3\times10^4$ is at least 5% with respect to the entire binding resin, in which the weight-average molecular weight ranges from 10,000 to 500,000, in which a Z-average molecular weight ranges from 20,000 to 5,000,000, in which a ratio between a weight-average molecular weight and a number-average molecular weight (weight-average molecular weight/number-average molecular weight) ranges from 3 to 150, in which a ratio between the Z-average molecular weight and the number-average molecular weight (Z-average molecular weight/number-average molecular weight) ranges from 10 to 2000, in which the melting temperature ranges from 80° C. to 150° C. measured by a ½ method with a capillary rheometer flow-tester of a constant pushing force type, in which a flow-beginning temperature ranges from 80° C. to 120° C., and in which the glass transition point of the resin ranges from 45° C. to 68° C., and wherein the polyester resin is obtained by a condensation polymerization between an alcohol component and a carboxylic acid component.

2. The two-component developer according to claim 1, wherein the resin coating layer further comprises conductive microparticles within a range oft to 1 to 5 weight parts with respect to 100 weight parts of the coating resin.

3. The two-component developer according to claim 1, wherein the proportion of the coating resin is within a range of 0.1 to 5.0 weight parts with respect to 100 weight parts of the carrier core material.

4. The two-component developer according to claim 1, wherein the organic silicon compound containing a perfluoro alkyl group is at least one compound selected from $CF_3CH_2CH_2Si(OCH_3)_3$, $C_4F_9CH_2Si(CH_3)(OCH_3)_2$, $C_8F_{17}CH_2CH_2Si(OCH_3)_3$, $C_8F_{17}CH_2CH_2Si(OC_2H_5)_3$, and $(CF_3)_2CF(CF_2)_8CH_2CH_2Si(OCH_3)_3$.

5. The two-component developer according to claim 1, wherein the polyorganosiloxane is at least one selected from Chemical Formulas 1 and 2 below:

Chemical Formula 1

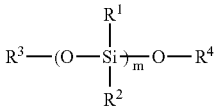

where $R^1$ and $R^2$ denote a hydrogen atom, a halogen atom, a hydroxy group, a methoxy group, or a C1 to C4 alkyl group or phenyl group, $R^3$ and $R^4$ denote a C1 to C4 alkyl group or phenyl group, and m denotes an average polymerization degree and is a positive integer, Chemical Formula 2

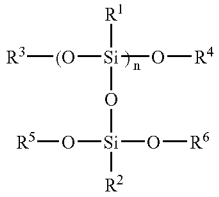

where $R^1$ and $R^2$ denote a hydrogen atom, a halogen atom, a hydroxy group, a methoxy group, or a C1 to C4 alkyl group or phenyl group, $R^3$, $R^4$, $R^5$ and $R^6$ denote a C1 to C4 alkyl group or phenyl group, and n denotes an average polymerization degree and is a positive integer.

6. The two-component developer according to claim 1, wherein the aminosilane coupling agent is at least one selected from γ-(2 -aminoethyl)aminopropyltrimethoxysilane, γ-(2-aminoethyl)aminopropylmethyldimethoxysilane, and octadecylmethyl[3-(trimethoxysilyl)propyl]ammonium chloride.

7. The two-component developer according to claim 1, wherein an amine of the aminosilane coupling agent is a primary amine.

8. The two-component developer according to claim 1, wherein the alcohol component is bisphenol A propylene oxide additive.

9. The two-component developer according to claim 1, wherein the carboxylic acid component is at least one selected from the group consisting of terephtalic acid, 1, 2, 4-benzenetricarboxylic acid, succinic acid and fumaric acid.

* * * * *

UNITED STATES PATENT AND TRADEMARK OFFICE

CERTIFICATE OF CORRECTION

PATENT NO. : 7,470,497 B2
APPLICATION NO. : 10/529536
DATED : December 30, 2008
INVENTOR(S) : Yuasa et al.

It is certified that error appears in the above-identified patent and that said Letters Patent is hereby corrected as shown below:

On the Title page, Item (73) Assignee data should include: -- POWDERTECH CO., LTD., Chiba (JP) --.

Signed and Sealed this

Ninth Day of November, 2010

David J. Kappos

David J. Kappos
*Director of the United States Patent and Trademark Office*